United States Patent [19]

Pape

[11] 4,315,871

[45] Feb. 16, 1982

[54] CARBURETOR CONTROL DEVICE FOR CARBURETORS IN INTERNAL-COMBUSTION ENGINES

[75] Inventor: Erwin Pape, Calberlah, Fed. Rep. of Germany

[73] Assignee: Volkswagenwerk Aktiengesellschaft, Wolfsburg, Fed. Rep. of Germany

[21] Appl. No.: 121,231

[22] Filed: Feb. 13, 1980

[30] Foreign Application Priority Data

Feb. 16, 1979 [DE] Fed. Rep. of Germany ..... 2905911

[51] Int. Cl.[3] ..... F02M 19/12

[52] U.S. Cl. ..... 261/65

[58] Field of Search ..... 261/65

[56] References Cited

U.S. PATENT DOCUMENTS 3,093,699 6/1963 Demitz ..... 261/65
3,116,906 1/1964 Callahan ..... 261/65
3,214,150 10/1965 Rice ..... 261/65
3,275,306 9/1966 Phillips ..... 261/65
4,177,784 12/1979 Tatsutomi et al. ..... 261/65

OTHER PUBLICATIONS

Webster's Seventh New Collegiate Dictionary, p. 485, Apr. 1965, G. & C. Meriam Co.

*Primary Examiner*—Tim R. Miles
*Attorney, Agent, or Firm*—Spencer & Kaye

[57] ABSTRACT

A carburetor control system for an internal combustion engine carburetor provided with a throttle valve and a shaft operating the valve, the system including a basic actuating member connected in a form-locking manner with respect to rotation, and at a defined angular position, to the throttle valve shaft, and a set of throttle valve levers having respectively different configurations but each connectable to the basic actuating member without play for enabling the carburetor valve to be controlled by a respectively different actuating structure.

7 Claims, 8 Drawing Figures

CARBURETOR CONTROL DEVICE FOR CARBURETORS IN INTERNAL-COMBUSTION ENGINES

BACKGROUND OF THE INVENTION

The present invention relates to a carburetor control device for carburetors used in internal combustion engines.

Customarily automobile manufacturers produce a variety of vehicles and, additionally, each individual vehicle type may be equipped with internal combustion engines having different power outputs so that a wide range of vehicles results. Although this has the advantage that the desires of individual customers can be better satisfied, it creates the significant drawback that the multitude of parts which must be fabricated and stored produces considerable expenditures for control and storage.

Often the various vehicle engine types or engine options use essentially similar internal combustion engines which differ only in the design of the actuating lever at the carburetor. Standardization of these actuating levers is generally impossible without extensively redesigning the vehicle. Since the internal combustion engine will be installed in different positions, e.g. longitudinal position, transverse position, etc. in different vehicle models, there results different spatial installation conditions, for example, for the carburetor. Moreover, the dimensioning of the carburetor actuating lever, i.e. the throttle lever, must often take into consideration differences in the transmission ratio of the gas pedals.

It would be conceivable to reduce these difficulties by first manufacturing the carburetor without the actuating lever and storing it that way, and then attaching the throttle levers later, i.e. during final assembly of the vehicle or during carburetor replacement repair work in a repair facility. Such procedure would not be practicable, however, because it could not be assured that the basic setting of the throttle valve as it is customarily effected by the manufacture of the carburetor would remain the same during installation of the actuating lever on the carburetor.

SUMMARY OF THE INVENTION

It is an object of the present invention to provide a carburetor control device for the carburetor of an internal combustion engine which makes it possible for one and the same type of carburetor to be used for the same or similar engines in different installation positions.

This and other objects are achieved, according to the invention by the provision of a carburetor control system for an internal combustion engine carburetor provided with a throttle valve and a shaft operating the valve, which system includes a basic actuating member connected in a form-locking manner with respect to rotation, and at a defined angular position, to the throttle valve shaft and a set of throttle valve levers having respectively different configurations but each connectable to the basic actuating member without play for enabling the carburetor valve to be controlled by a respectively different actuating structure.

DESCRIPTION OF THE PREFERRED EMBODIMENTS

Figure 1:
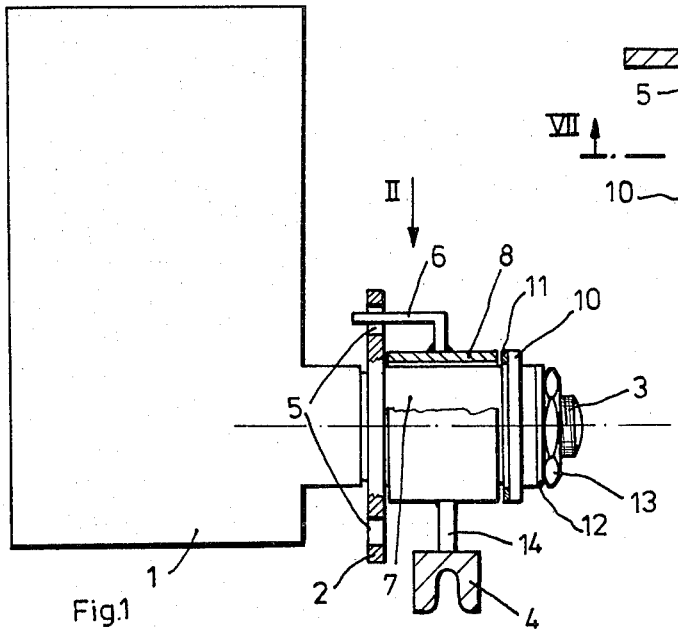
FIG. 1 is an elevational view, partly in cross section, illustrating a conventional carburetor equipped with a preferred embodiment of a control device according to the invention.

The drawing figures show only those details of a carburetor for internal-combustion engines required for an understanding of the present invention.

FIG. 1 shows, in a partially cross-sectional view, the side of a completed carburetor. A basic actuating disc 2 has been form-lockingly placed in a defined angular position onto a throttle shaft 3 so that defined positional relationships exist between the throttle (not shown) of the carburetor and the basic actuating disc 2.

Figure 7:
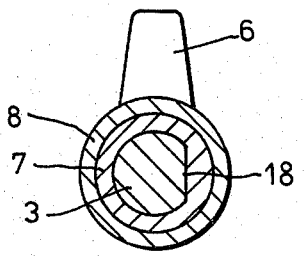
FIG. 7 is a detail cross-sectional view taken in the direction of arrow VII in FIG. 2.

The form locking connection at a defined angle between the throttle shaft 3 and the basic actuating disc 2 can be assured, for example, by corresponding guide faces 18 etc. on these components as shown in FIG. 7.

Figure 2:
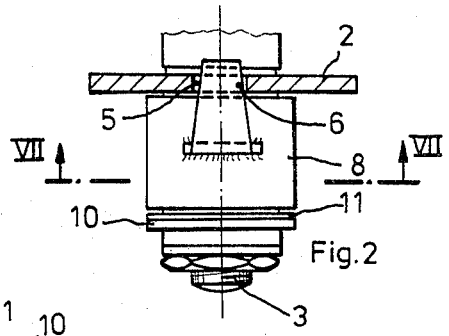
FIG. 2 is a detail plan view taken in the direction of arrow II of FIG. 1.
Figure 3:
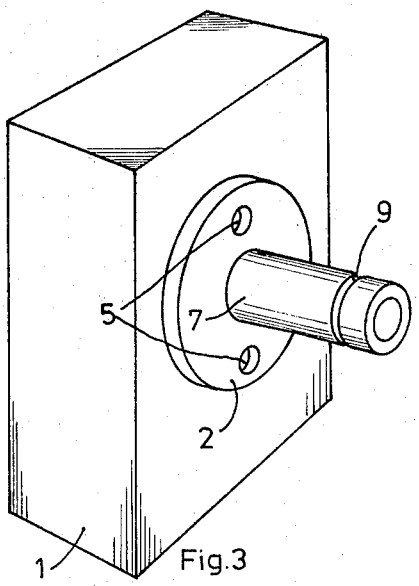
FIG. 3 is a perspective view showing the carburetor of FIG. 1 with portions of the control device removed.

In the illustrated embodiment, the basic actuating disc 2 includes a cylindrical bearing pin 7 which is oriented coaxially to the throttle shaft 3, as is quite apparent from FIGS. 1 to 3.

The actual throttle lever 4 is mounted on this cylindrical bearing pin 7. In the illustrated embodiment the throttle lever 4 is composed essentially of a cylindrical sleeve member 8 pushed onto the cylindrical bearing pin 7, an axially oriented finger-like member 6 extending toward the basic actuating disc 2 and a lever arm 14 at which is articulated the accelerator linkage rod or cable, respectively (not shown). The axially projecting finger-like member 6 engages in a corresponding, precisely located recess 5 of the basic actuating disc 2.

The cylindrical bearing pin 7 is provided with a circumferential annular groove 9, seen in FIG. 3, into which is inserted a retaining ring 10 or the like when the throttle lever 4 has been pushed into place. Ring 10 axially fixes the throttle lever in position relative to pin 7 via its sleeve member 8. Between sleeve member 8 and ring 10 there is provided a spring disc 11 or the like which presses the finger-like member 6 under tension and without play, due to the axial spring force of the disc, into the recess 5 of the basic actuating disc.

The same defined relationships then exist between throttle lever 4 and the carburetor throttle valve, with respect to space and to their angular position, as exist between the basic actuating disc 2 and that throttle valve. The member 6 is here advantageously given a wedge shape, as seen in FIG. 2, so as to assure the freedom from play between lever 4 and disc 2.

In the illustrated embodiment, the basic actuating disc 2 is provided with two different, spatially separated recesses 5 so that the possibility exists of having the axially projecting finger-like member 6 engage in either the one or the other recess. This already permits the provision of two different types of carburetors requiring only a single throttle lever design.

Figure 4:
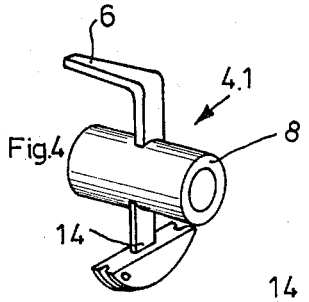
FIGS. 4–6 are perspective detail views of alternative embodiments of a component of the control device according to the invention.
Figure 5:
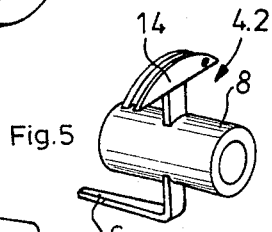
Figure 6:
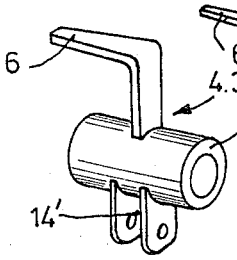

It is furthermore possible, in a simple manner, to equip a plurality of engine types with the same basic type of carburetor by attaching throttle levers which are particularly adapted to the given installation conditons, etc. FIGS. 4 to 6 show a few conceivable variations of special types of throttle levers.

For example, FIG. 4 show a throttle lever 4.1 whose axially projecting finger-like member 6 is arranged to engage in the upper bore 5 of the basic actuating disc 2 so that the acceleration cable coming from the vehicle accelerator pedal would engage at the downwardly oriented lever arm 14 and would pivot it to the right, i.e. counterclockwise, when the accelerator pedal is depressed.

In FIG. 5, on the other hand, however, a throttle valve lever 4.2 is shown with its finger-like member 6 arranged to engage in the lower recess 5 of the basic actuating disc 2 so that the accelerator cable coming from the accelerator pedal would deflect the upwardly projecting lever arm 14 to the left, again counterclockwise, when the accelerator pedal is depressed. Therefore, as can easily be seen from a consideration of FIG. 3 the carburetor throttle valve would be displaced in the same direction as that effected by the throttle valve lever 4.1 of FIG. 4.

Finally, FIG. 6 shows a further throttle valve lever 4.3 whose downwardly projecting lever arm 14' is composed of the two spaced bars serving as bearing jaws for the bearing shaft of a known accelerator rod assembly.

For the sake of completeness, FIG. 1 also shows that the basic actuating disc 2, or its cylindrical pin 7, can be fastened on the throttle lever shaft 3 with the aid of a washer 12 and a nut 13. FIG. 2 supplements the showing of the connection between the basic actuating disc 2 and the throttle valve lever 4.

It is understood that supplementary to the illustrated embodiments the connection between the basic actuating disc, which may have a shape different from that illustrated, and the throttle valve lever, may also be of different design. The important thing in each case is only that the various types of throttle valve levers have uniform fastening points adapted to the basic actuating disc so that a defined association between the position of the throttle valve lever and the position, or setting, of the throttle valve is always assured. It is conceivable for example, inter alia, to dispose tongues or the like which project from the basic actuating disc and to provide the individual throttle valve levers with corresponding recesses.

It is also not absolutely necessary to connect the throttle valve levers with the basic actuating disc by using a cylindrical bearing pin and a cylindrical sleeve. It would also be conceivable to have the levers lie flush against the basic actuating disc, it being then necessary, however, that two recesses correspond with two respective projections.

The arrangement of a carburetor or the associated control device, respectively, according to the present invention provided a multitude of ways for simplification or combination. For example, the same type of carburetor can be used for different installation situations in different types of vehicles; under certain circumstances the same throttle valve lever, accelerator cable abutment and accelerator cables can be used for all carburetor designs used with the same type of vehicle and there exists greater flexibility and better opportunities for variation for future engine/vehicle combinations.

Figure 8:
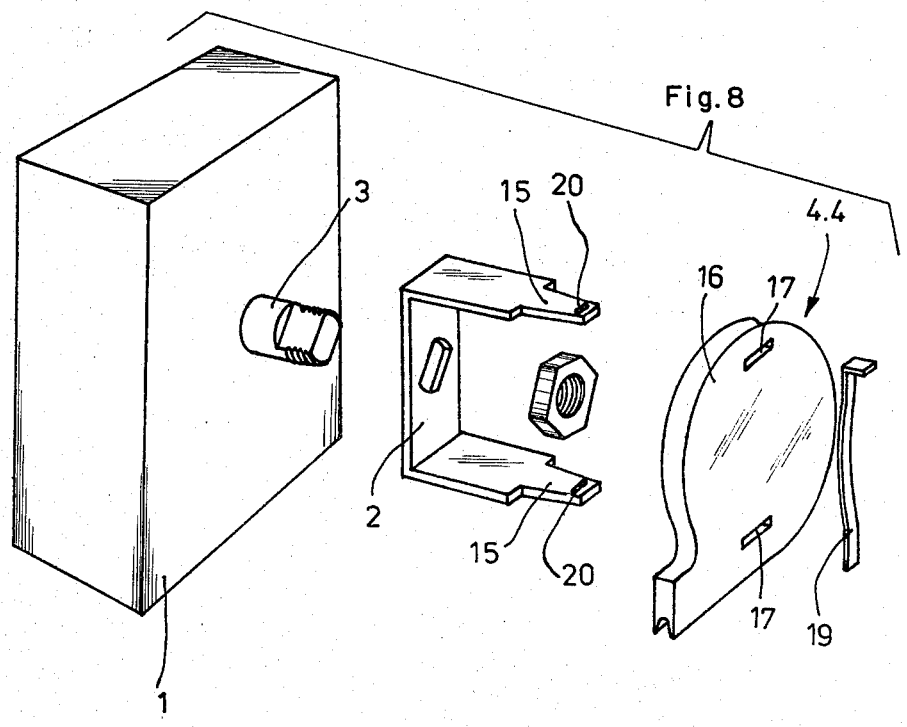
FIG. 8 is a perspective detail view of an alternative embodiment of components of the control device according to the invention.

FIG. 8 shows an alternative arrangement according to the present invention in which the basic actuating disc 2 includes two finger-like members 15 projecting from the plane of said disc. The actual throttle lever 4.4 forming a flat disc 16 includes two slot-like recesses 17 into which the two wedge shaped finger-like members 15 engage without play and under tension when the lever 4.4 is mounted on said both members.

In the illustrated embodiment the basic actuating disc 2 and the two finger-like members 15 form a U-shaped element with a rectangular disc 2 which is to be fastened to the throttle shaft 3 with aid of a nut not numbered, a slot within said disc 2 not numbered, and guide faces on the throttle shaft 3 corresponding with said slot and not numbered either. The lever 4.4 is to be secured when mounted on the two finger-like members 15 with aid of a flat spring 19 which it to put through two recesses 20 arranged on the outer ends of said finger-like members 15.

It will be understood that the above description of the present invention is susceptible to various modifications, changes and adaptations, and the same are intended to be comprehended within the meaning and range of equivalents of the appended claims.

What is claimed is:

1. A carburetor control system for an internal combustion engine carburetor provided with a throttle valve and a shaft operating the valve, said system comprising a basic actuating member connected in a form-locking manner with respect to rotation, and at a defined angular position, to the throttle valve shaft, and a set of throttle valve levers having respectively different configurations, with one selected lever of said set being releasably connected to said basic actuating member without play for enabling the carburetor valve to be controlled by a respective actuating structure.

2. An arrangement as defined in claim 1 wherein said selected throttle valve lever is connected to said basic actuating member in a manner to undergo pivotal movement about the axis of the throttle valve shaft.

3. A carburetor control system for an internal combustion engine carburetor provided with a throttle valve and a shaft operating the valve, said system comprising a basic actuating member connected in a form-locking manner with respect to rotation, and at a defined angular position, to the throttle valve shaft, and a throttle valve lever releasably connectable to said basic actuating member without play in a selected one of at least two different positions for enabling the carburetor valve to be controlled by an actuating structure, wherein said basic actuating member is a disc provided with at least one recess and said lever includes an axially projecting, finger-like member which engages without play and under tension into said recess when said lever is fastened to said actuating disc.

4. A carburetor control system for an internal combustion engine carburetor provided with a throttle valve and a shaft operating the valve, said system comprising a basic actuating member connected in a form-locking manner with respect to rotation, and at a defined angular position, to the throttle valve shaft, and a throttle valve lever releasably connectable to said basic actuating member without play in a selected one of at least two different positions for enabling the carburetor valve to be controlled by an actuating structure, wherein said basic actuating member is a disc provided with at least one finger-like member which projects from the plane of said disc, and said lever is provided with a recess into which said finger-like member engages without play and under tension when said lever is fastened to said actuating disc.

5. An arrangement as defined in claim 3 or 4 wherein said finger-like member has a wedge shape.

6. An arrangement as defined in claim 3 or 4 wherein said basic actuating member includes a cylindrical bearing pin which is oriented to be coaxial with the throttle valve shaft and said throttle valve lever is provided with a cylindrical sleeve member arranged to be pushed onto said bearing pin so that said finger-like member can come into engagement with its associated recess.

7. An arrangement as defined in claim 6 wherein said bearing pin is provided with a circumferential annular groove and said system further comprises: a safety ring arranged to be seated in said groove when said throttle valve lever has been pushed onto said bearing pin, for axially fixing its said sleeve member on said bearing pin; and spring means arranged to be inserted between said sleeve member and said safety ring for imposing an axial tensioning force between said bearing pin and said throttle valve lever.

* * * * *